US006050657A

United States Patent [19]

Hiltzman

[11] Patent Number: 6,050,657

[45] Date of Patent: Apr. 18, 2000

[54] SHELF ORGANIZER SYSTEM

[76] Inventor: Jerry R. Hiltzman, P.O. Box 1093, Cushing, Okla. 74023

[21] Appl. No.: 09/246,338

[22] Filed: Feb. 8, 1999

[51] Int. Cl.[7] ..... F16B 12/00

[52] U.S. Cl. ..... 312/111; 312/107

[58] Field of Search ..... 312/107, 108, 312/111, 263, 257.1, 349, 351, 265.6

[56] References Cited

U.S. PATENT DOCUMENTS

| | | | |
|---|---|---|---|
| 2,011,962 | 8/1935 | Wheatley | 312/111 X |
| 3,514,170 | 5/1970 | Shewchuk | 312/111 X |
| 3,552,817 | 1/1971 | Marcolongo | 312/111 X |
| 3,743,372 | 7/1973 | Ruggerone | 312/111 X |
| 3,851,936 | 12/1974 | Muller | 312/111 X |
| 3,999,818 | 12/1976 | Schankler | 312/111 |
| 4,198,777 | 4/1980 | Cruzan et al. . | |
| 4,238,032 | 12/1980 | Thurman . | |
| 4,353,470 | 10/1982 | Polhemus et al. . | |
| 4,589,546 | 5/1986 | Sunderland . | |
| 4,744,612 | 5/1988 | Winter et al. | 312/263 X |
| 4,782,619 | 11/1988 | Richards . | |
| 4,874,210 | 10/1989 | Carroll | 312/108 X |
| 4,907,703 | 3/1990 | Alger et al. . | |
| 5,046,789 | 9/1991 | Lee | 312/108 |
| 5,137,340 | 8/1992 | Cugley et al. | 312/111 X |
| 5,176,435 | 1/1993 | Pipkens | 312/265.6 X |
| 5,191,983 | 3/1993 | Hardy . | |
| 5,344,024 | 9/1994 | Cohu . | |
| 5,399,004 | 3/1995 | Buschle . | |
| 5,454,634 | 10/1995 | Herbst et al. | 312/111 X |

FOREIGN PATENT DOCUMENTS

| | | | |
|---|---|---|---|
| 1544144 | 10/1986 | France | 312/111 |

*Primary Examiner*—Peter M. Cuomo
*Assistant Examiner*—James O. Hansen
*Attorney, Agent, or Firm*—Edward A. McConwell, Jr.

[57] ABSTRACT

A modular shelf system having a plurality of shelf modules of various sizes for constructing a modular system for storing or displaying variously sized items. Each module includes opposed walls with an open front side. One wall presents a male attachment structure while the opposed wall defines a female receptacle configured to receive the male attachment structure. The system includes a pair of finish panels for attractively covering the attachment structures of the modules. One panel includes a first generally smooth side and a second side that defines a female receptacle such that the panel can be detachably coupled with a male attachment structure of a shelf module. The second panel presents a first smooth side and a second side having a male attachment structure suitable for detachably coupling with a female receptacle of a shelf module. The lower wall of each shelf module presents connectors which can be detachably coupled with apertures in each upper shelf module wall. The system further includes a top finish panel which can be detachably coupled to the upper walls of the shelf modules.

2 Claims, 11 Drawing Sheets

Section 6-6

SHELF ORGANIZER SYSTEM

BACKGROUND OF THE INVENTION

This invention relates generally to storage systems and, more particularly, to a modular shelf system having modules which can be variably configured to create desired shelf structures.

Many devices and structures are known for storing and displaying various items, particularly in the retail industry. Some storage structures, however, are only suitable to hold or display particular items. Other structures are not variably configurable for creating multi-purpose systems. Further, known modular storage structures do not include smooth, removable side or top panels.

Thus, it is desirable to have a modular shelf system having modules which can be laterally and vertically coupled for creating any of a number of desired configurations. It is also desirable to have a system with variously sized modules for holding or displaying items. Further, the system includes aesthetically attractive panels which can removably surround the configured system.

SUMMARY OF THE INVENTION

A modular shelf system according to the present invention includes a plurality of shelf modules. Each shelf module includes opposed side walls with an open front side. The outer surface of one wall includes a male attachment structure having a trapezoidal configuration while the outer surface of the opposed wall defines a channel having a trapezoidal configuration for receiving a male attachment structure therein. Multiple shelf modules can thus be laterally coupled as desired. The system further includes a pair of finish panels that can be detachably coupled to opposed sides of the shelf module. One side of a first panel is generally smooth while the opposed side defines a trapezoidal shaped channel. One side of a second panel is smooth while the opposed side presents a male attachment structure having a trapezoidal configuration. Thus, the finish panels can be releasably coupled to the walls of the shelf module so as to hide the attachment structures from view.

Each shelf module further includes upper and lower walls which are adapted to allow shelf modules to be stacked one on top of another. The lower surface of each lower wall includes downwardly extending flanges which can be frictionally fitted within apertures defined by the upper walls. A top finish panel having downwardly extending flanges can also be snappably secured to upper surfaces of shelf modules. Shelf modules may include traditional or inclined shelves for storing or displaying various items.

It is therefore a general object of this invention to provide a shelf system having modules which can be coupled to form desired storage or display configurations.

Another object of this invention is to provide a system, as aforesaid, having trapezoidal fastening means on opposed module side walls for laterally coupling modules together.

Still another object of this invention is to provide a system, as aforesaid, in which modules can be vertically coupled together.

A further object of this invention is to provide a system, as aforesaid, having detachable panels which present a smooth exterior surface to a completed system configuration.

A still further object of this invention is to provide a system, as aforesaid, which can utilize modules of various sizes and shelf configurations.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 2:
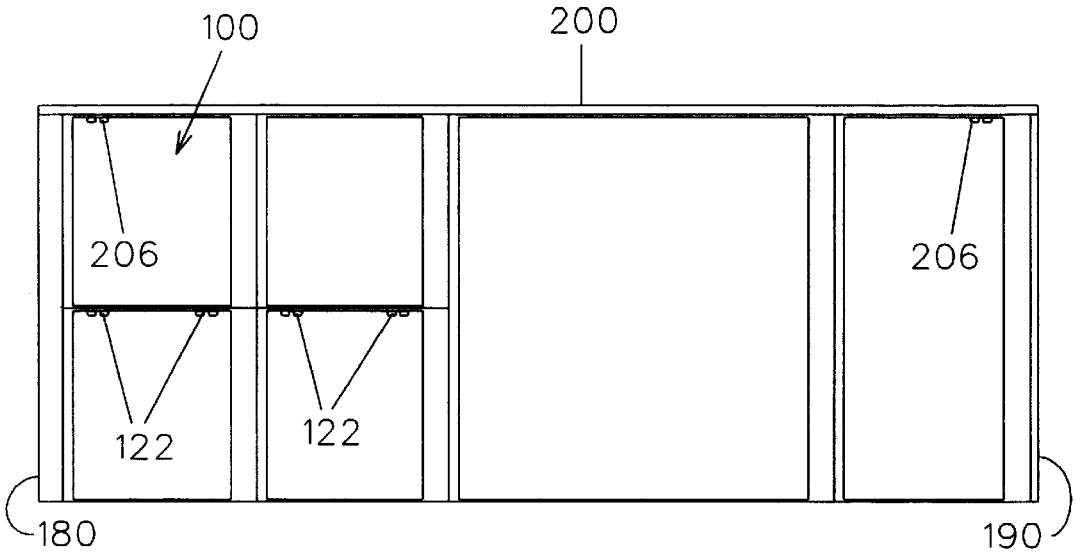
FIG. 2 is a front view of the shelf system of FIG. 1.
Figure 3:
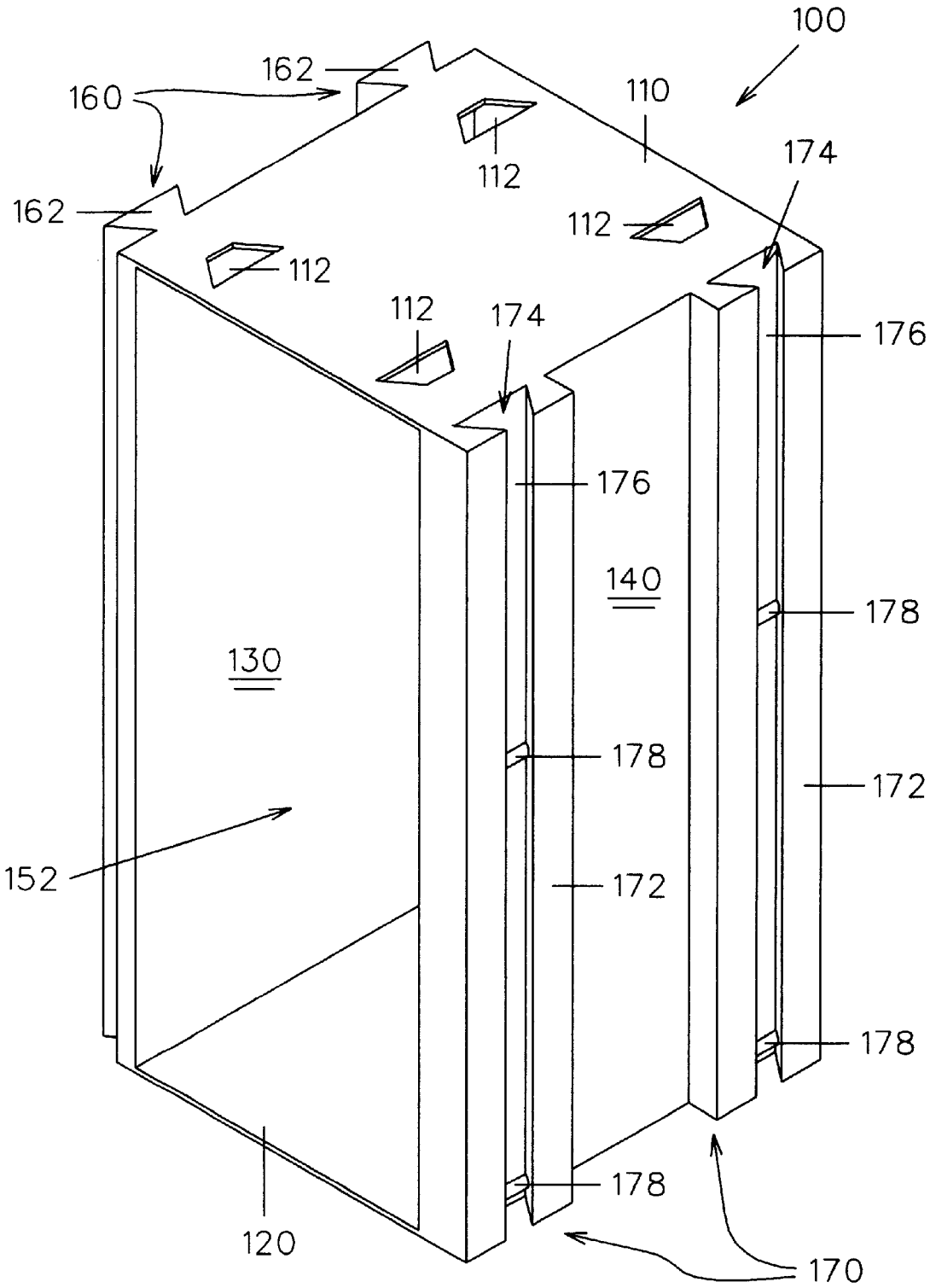
FIG. 3 is a front perspective view of one shelf module of the shelf system of FIG. 1.
Figure 4:
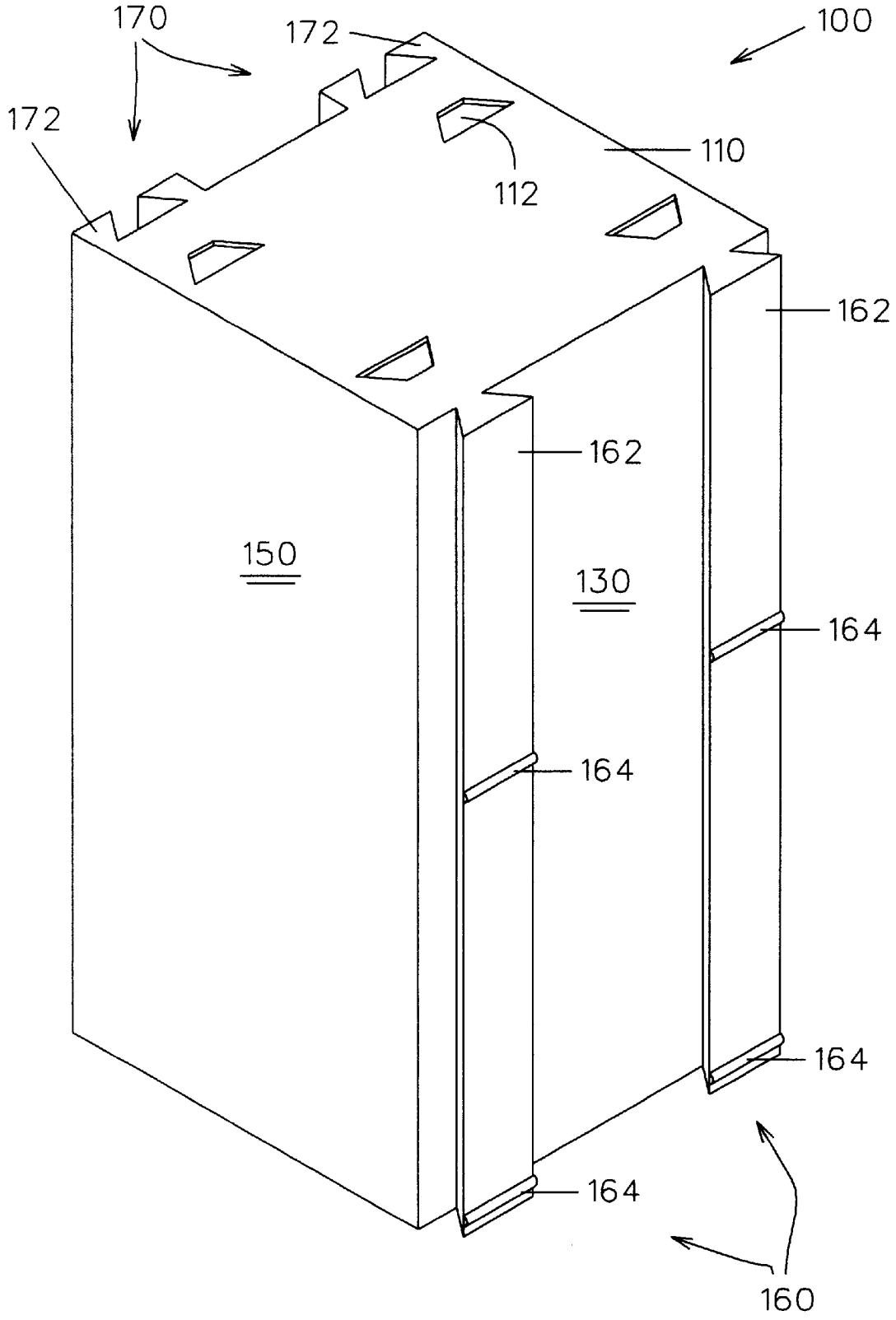
FIG. 4 is a rear perspective view of the module of FIG. 3.
Figure 5:
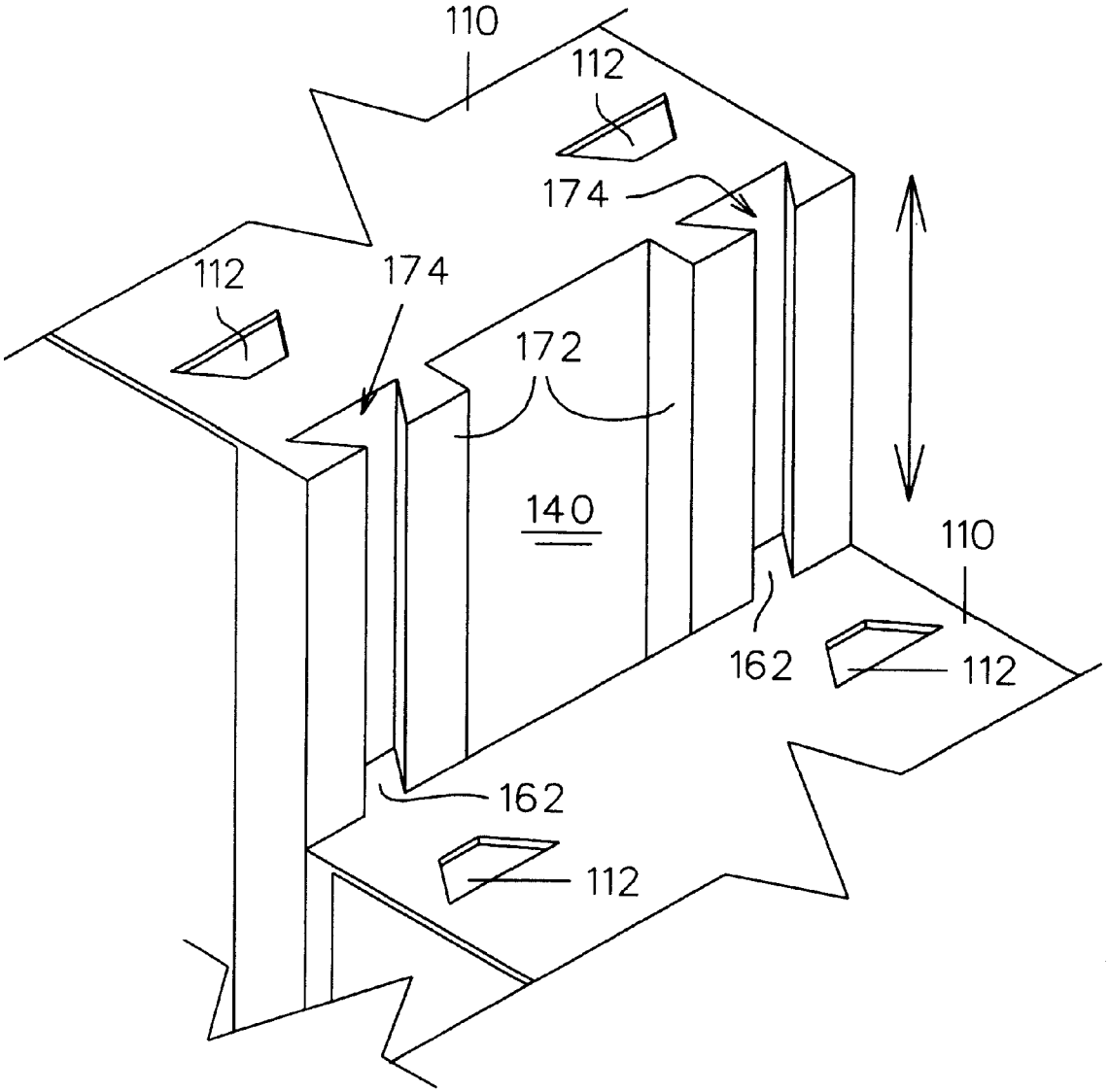
FIG. 5 is a broken perspective view showing the coupling of two shelf modules.

A modular shelf system 10 in accordance with a preferred embodiment of the present invention includes a plurality of shelf modules 100 (FIGS. 2 and 3). Although the shelf modules can have various dimensions, each module presents a substantially similar structure. As shown in FIGS. 3 and 4, each shelf module 100 includes upper 110 and lower 120 walls with oppositely disposed first 130 and second 140 side walls intermediate the upper 110 and lower 120 walls. Each module 100 further includes a rear wall 150 intermediate first 130 and second 140 side walls and extending between upper 110 and lower 120 walls. Each shelf module 100 has an open front side 152 for placing items within the module for storage or display.

The first side wall 130 of each shelf module 100 presents a male attachment structure 160 extending along the exterior surface thereof and protruding therefrom (FIG. 4). Preferably, the male attachment structure 160 comprises a pair of spaced apart elongated members 162 extending between upper 110 and lower 120 walls. The elongated members 162 are parallel with respect to one another and present a trapezoidal or dovetail cross-sectional shape. Each elongated member 162 further includes a pair of vertically spaced apart annular flanges 164. Each flange 164 extends horizontally across the elongated member 162.

The second side wall 140 of each shelf module 100 includes a female receptacle 170 extending along the exterior surface thereof and protruding therefrom (FIG. 3). Preferably, the female receptacle comprises a pair of spaced apart elongated members 172 which are parallel to one another and extend between upper 110 and lower 120 walls.

Each elongated member 172 defines a channel 174 having a trapezoidal cross-section for receiving one of the elongated members 162 of the male attachment structure 160 therein. Each channel 174 includes a rear surface 176 that defines a pair of vertically spaced apart recesses 178 having an annular cross-section adapted to couple with the annular flanges 164 of the elongated member 162 when the member 162 is inserted into the channel 174, as shown in FIG. 6B.

Figure 9:
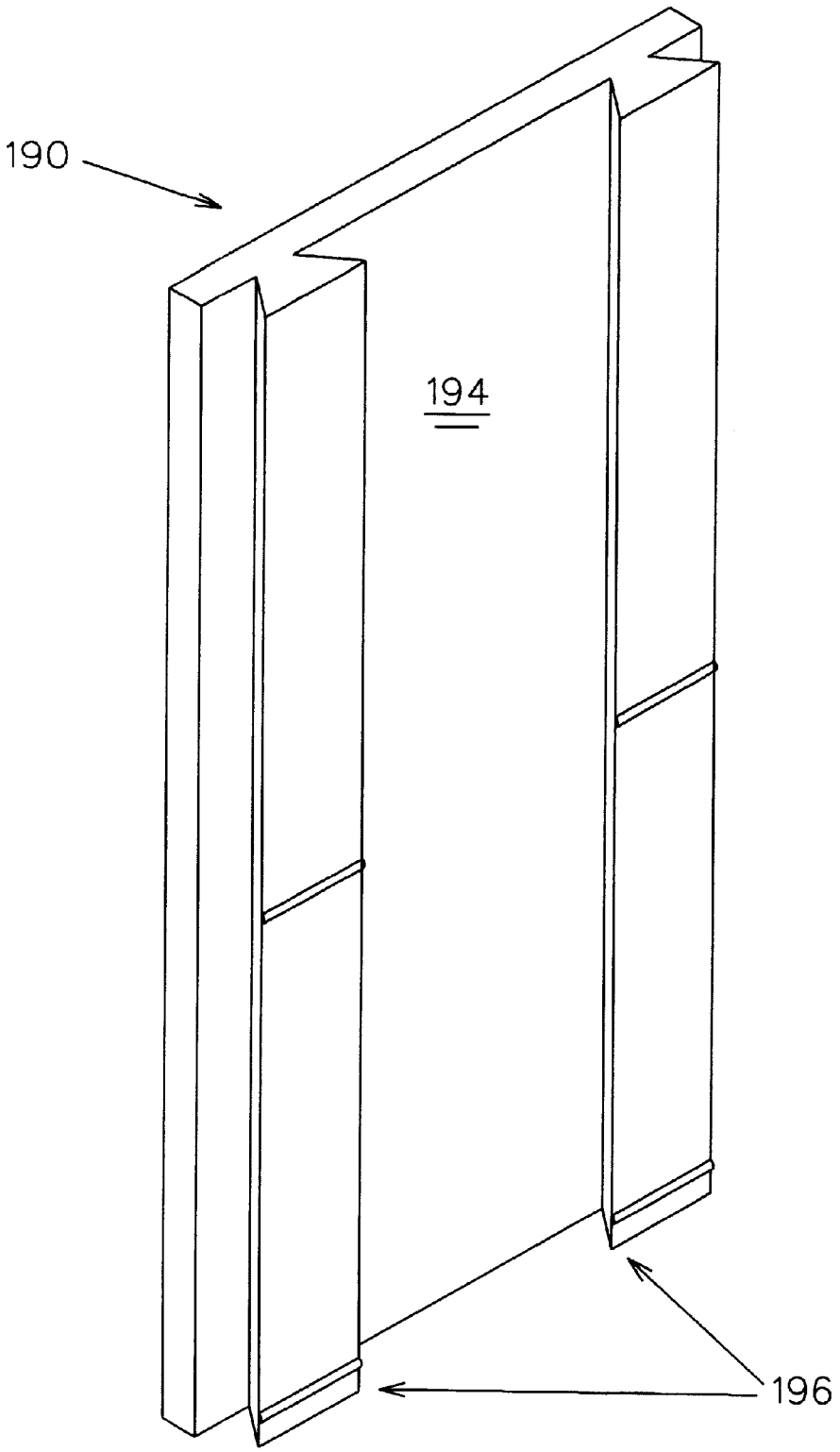
FIG. 9 is a perspective view of a right end finish panel.
Figure 10:
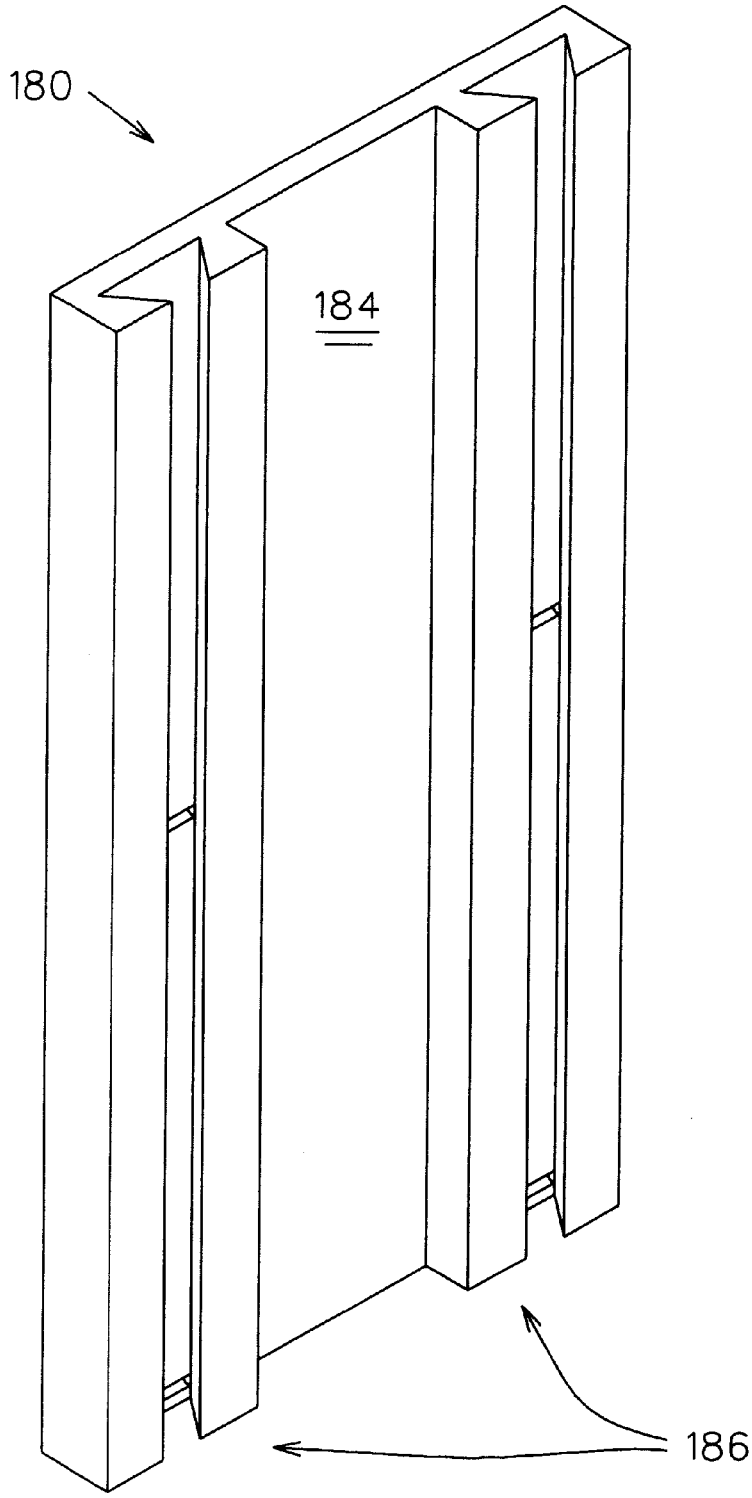
FIG. 10 is a perspective view of a left end finish panel.

As shown in FIGS. 9 and 10, the shelf system 10 further includes first 180 and second 190 detachable finish panels for covering the attachment structures 160, 170 of the shelf module side walls 130, 140. The first finish panel 180 includes a first generally smooth side (not shown) and a second side 184 defining a female receptacle 186 (FIG. 10) that is substantially similar to the female receptacle 170 described above. The second finish panel 190 includes a first generally smooth side 192 (FIG. 1) and a second side 194 presenting a male attachment structure 196 (FIG. 9) that is substantially similar to the male attachment structure 160 described above. Thus, the finish panels 180, 190 can be slidably and detachably coupled to the side walls 130, 140, respectively, of any desired shelf module 100 as shown in FIG. 1.

Figure 1:
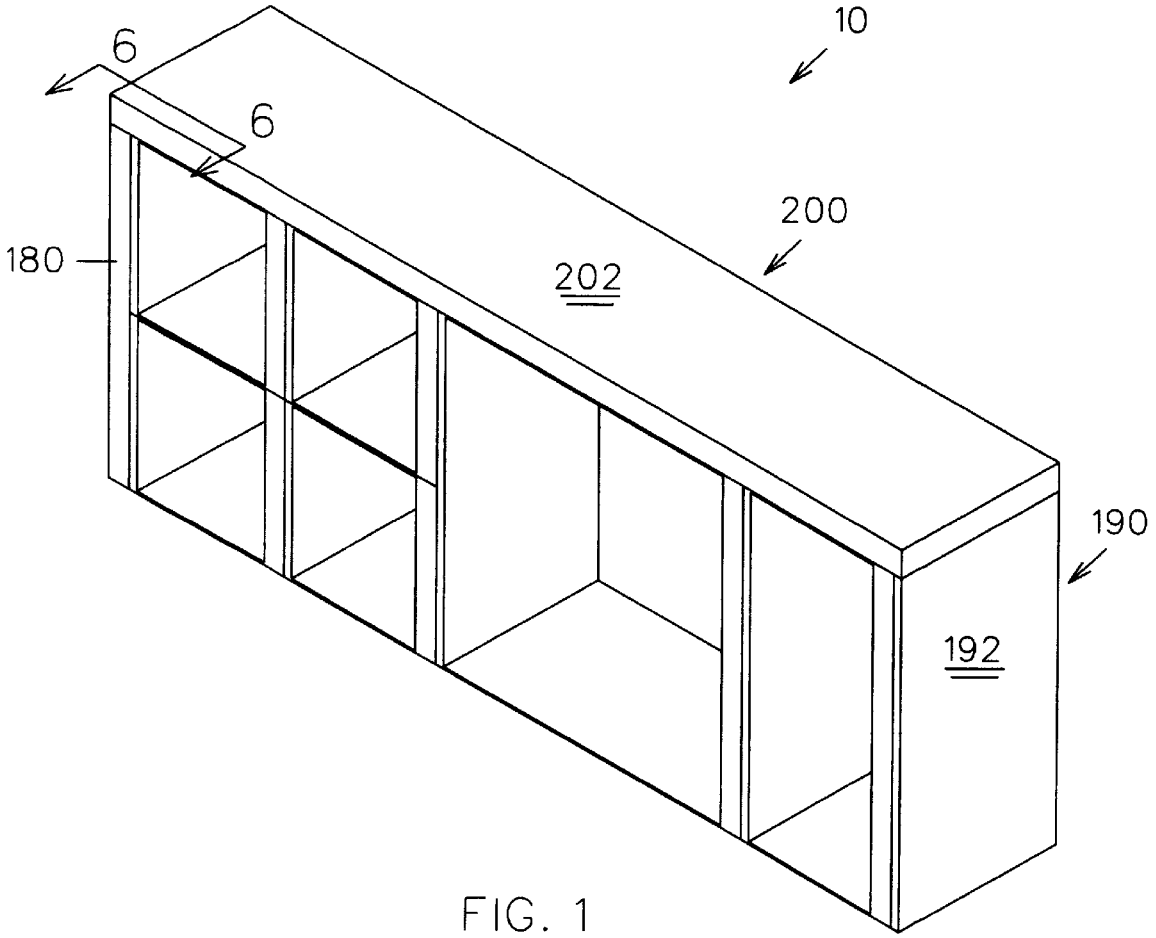
FIG. 1 is a perspective view of the shelf system in accordance with a preferred embodiment of the present invention.
Figure 11:
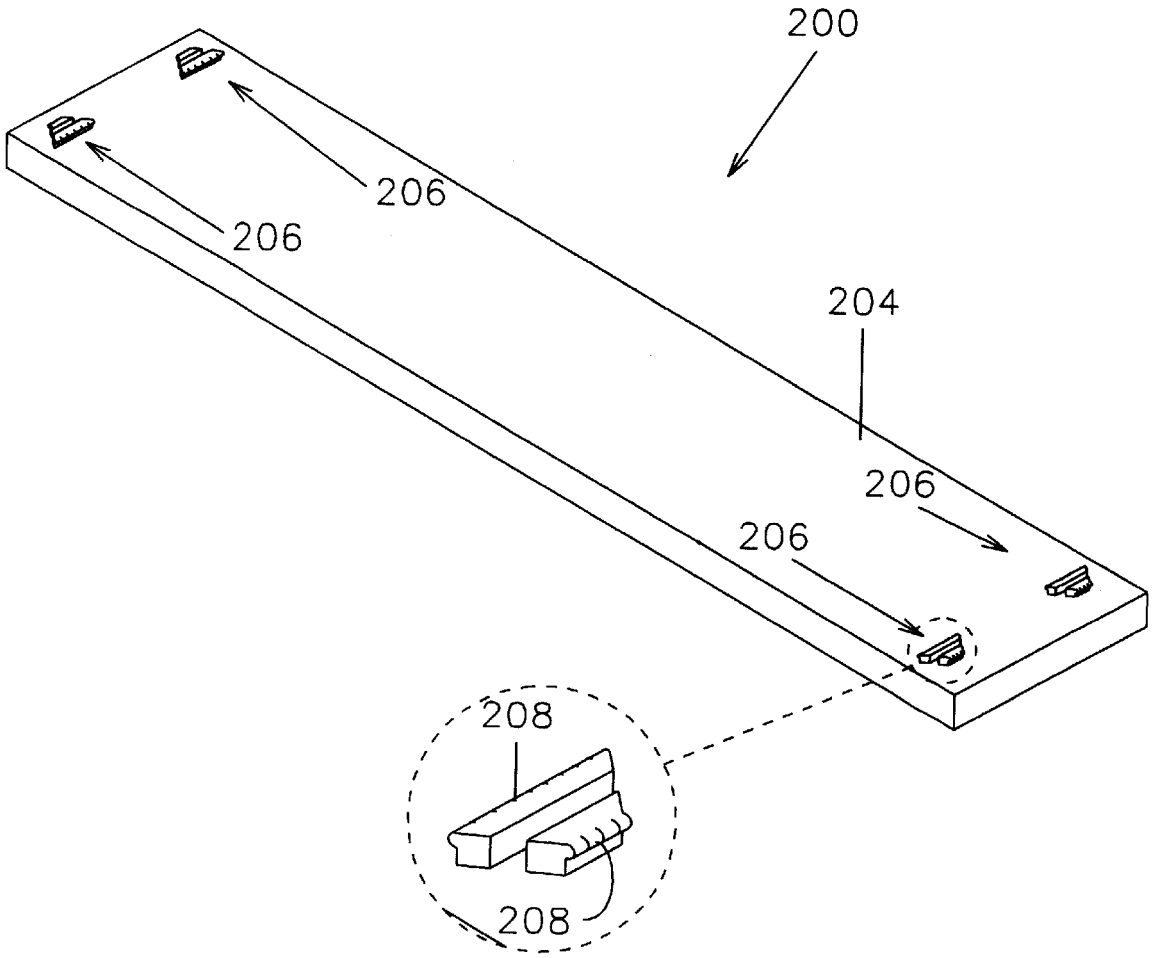
FIG. 11 is a perspective view of a top panel with an enlarged view of an attachment flange.

The shelf system 10 further includes a top finish panel 200 (FIGS. 1 and 11). The top panel 200 includes a generally smooth top side 202 and a bottom side 204 having a plurality of spaced apart downwardly extending connectors 206. Each connector 206 presents a trapezoidal cross-section, the parallel edges of which present outwardly extending lips 208 for frictionally fitting the top panel 200 to the upper wall 110 of a shelf module 100, as described more fully below.

Figure 6A:
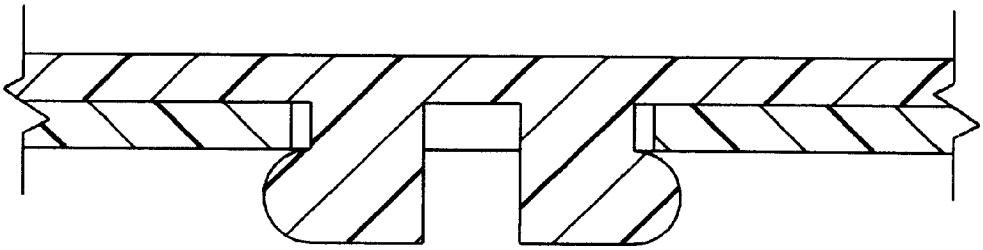
FIG. 6A is a sectional view taken along line 6—6 of FIG. 1 showing a top finish panel detachably coupled to the upper wall of a shelf module.
Figure 6B:
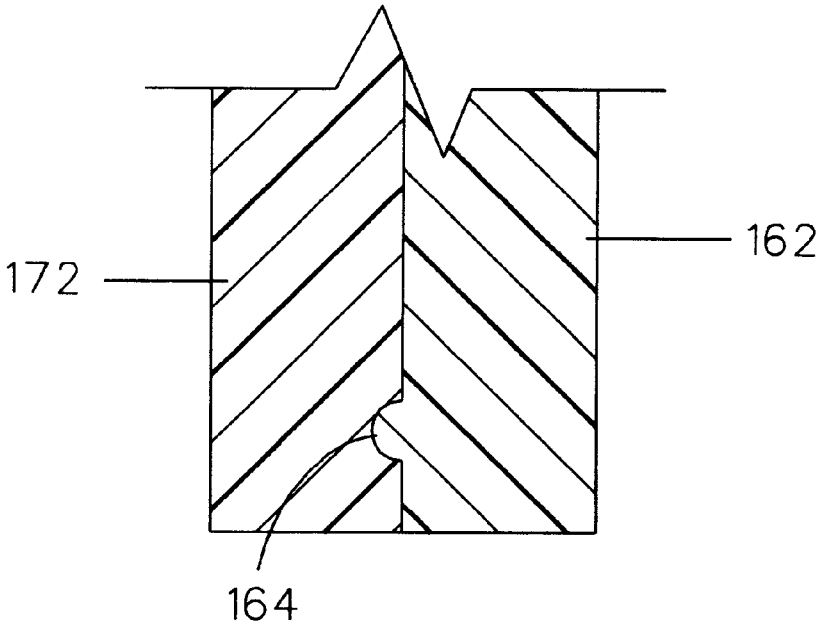
FIG. 6B is a sectional view taken along line 6—6 of FIG. 1 showing a first finish panel detachably coupled to a shelf module.

The upper wall 110 of each shelf module 100 defines a plurality of spaced apart apertures 112, each aperture having a trapezoidal configuration suitable for receiving one of the connectors 206 of the top panel 200 (FIGS. 3 and 6). The lower wall 120 of each shelf module 100 includes a plurality of spaced apart connectors 122 having a construction substantially similar to that of the top panel connectors 206 described above. Thus, the lower wall 120 of a shelf module 100 may be fitted to the upper wall 110 of another shelf module 100 for constructing a vertically extending modular system.

In use, the plurality of shelf modules 100 may be laterally coupled by slidably engaging the male attachment structure 160 of one shelf module 100 with the female receptacle 170 of another shelf module 100, and so on. Shelf modules 100 can also be vertically coupled by inserting the lower wall connectors 122 of one shelf module 100 into the upper wall apertures 112 of another module 100, and so on. When the shelf system 10 has been entirely constructed, side 180, 190 and top 200 finish panels can be coupled thereto to hide all attachment structures.

Figure 8:
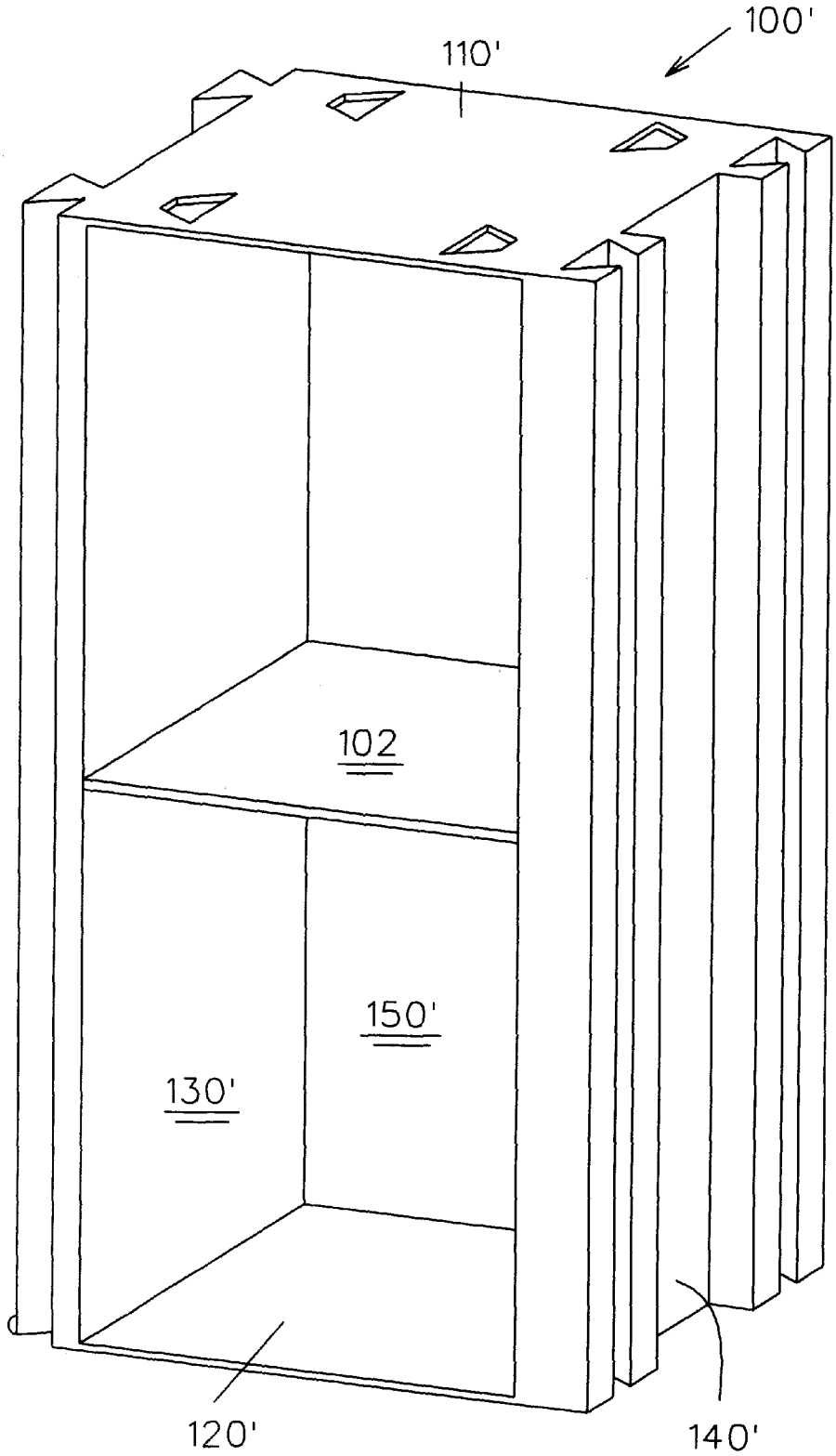
FIG. 8 is a perspective view of another alternative embodiment of a module.

As shown in FIG. 8, an alternative shelf module 100' includes a shelf 102 intermediate upper 110' and lower 120' walls and equally displaced therefrom. The shelf 102 is normal to the first 130' and second 140' side walls and parallel to upper 110' and lower 120' walls.

Figure 7:
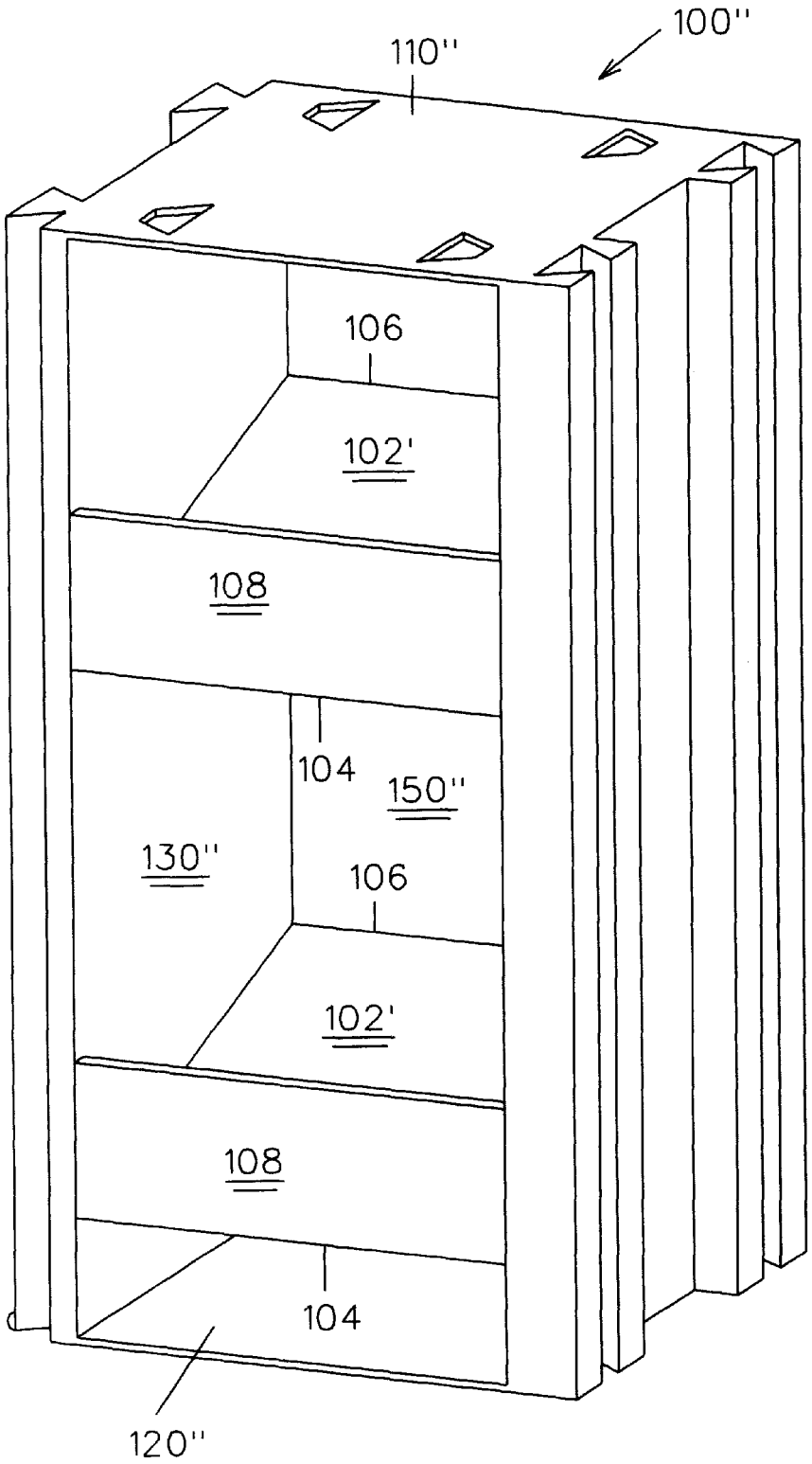
FIG. 7 is a perspective view of an alternative embodiment of a module.

Turning now to FIG. 7, a shelf module 100" of another alternative embodiment includes a pair of shelves 102' intermediately disposed between upper 110" and lower 120" walls with each shelf being displaced from the upper 110" or lower 120" wall, respectively. Each shelf 102' includes front 104 and rear 106 edges and is rearwardly inclined therebetween. Each shelf 102' includes an upstanding wall 108 normal to the upper wall 110" and fixedly attached to the front edge 104 of each shelf 102'. The upstanding wall 108 partially extends between each front edge 104 and the upper wall 110" for holding items placed on the shelf 102'.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A modular shelf system for storing and displaying variously sized items, comprising:

a shelf module having first and second walls and an open front, the first wall presenting a resilient male attachment structure, and the second wall defining a resilient female receptacle;

a first detachable sidewall having a first generally smooth side and a second side defining a resilient female receptacle configured for detachably coupling with the male attachment structure of the first wall;

a second detachable sidewall having a first generally smooth side and a second side presenting a resilient male attachment structure configured for detachably coupling with the female receptacle of the second wall;

wherein the male attachment structure of the shelf module includes an elongated member extending along the first wall and presenting a trapezoidal configuration;

wherein the male attachment structure of the second detachable sidewall includes an elongated member extending along the first side and presenting a trapezoidal configuration;

wherein the female receptacle of the shelf module includes an elongated member extending along the second wall and defining a channel configured to selectably receive the elongated member of the male attachment structure of the shelf module or the elongated member of the male attachment structure of the second sidewall;

wherein the female receptacle of the first sidewall includes an elongated member extending along the second side and defining a channel configured to receive the elongated member of the male attachment structure of the shelf module;

wherein the male attachment structure of the shelf module includes an annular flange extending longitudinally across the elongated member;

wherein the male attachment structure of the second sidewall includes an annular flange extending longitudinally across the elongated member;

wherein the female receptacle of the shelf module includes a rear surface defining an annular recess configured for selectably receiving the annular flange of the male attachment structure of the shelf module or the annular flange of the male attachment of the second sidewall; and wherein the female receptacle of the first sidewall includes a rear surface defining an annular recess configured for receiving the annular flange of the male attachment structure of the shelf module, whereby to enhance the coupling between any male attachment structures and female receptacles.

2. A modular shelf system, comprising:

a plurality of shelf modules, each shelf module having first and second walls and an open front, each first wall presenting a substantially similar male attachment structure, and each second wall defining a substantially similar female receptacle, each male attachment structure being configured for coupling with any of the female receptacles;

a first detachable sidewall having a first generally smooth side and a second side defining a female receptacle configured for detachably coupling with any of the male attachment structures of the first walls;

a second detachable sidewall having a first generally smooth side and a second side presenting a male attachment structure configured for detachably coupling with any of the female receptacles of the second walls;

wherein the male attachment structure of each shelf module includes an elongated member extending along the first wall and presenting a trapezoidal configuration;

wherein the male attachment structure of the second detachable sidewall includes an elongated member extending along the first side and presenting a trapezoidal configuration;

wherein the female receptacle of each shelf module includes an elongated member extending along the second wall and defining a channel configured to selectably receive the elongated member of the male attachment structure of the shelf module or the elongated member of the male attachment structure of the second sidewall;

wherein the female receptacle of the first sidewall includes an elongated member extending along the second side and defining a channel configured to receive the elongated member of the male attachment structure of the shelf module;

wherein the male attachment structure of each shelf module includes an annular flange extending longitudinally across the elongated member;

the male attachment structure of the second sidewall includes an annular flange extending longitudinally across the elongated member;

the female receptacle of each shelf module includes a rear surface defining an annular recess configured for selectably receiving the annular flange of the male attachment structure of the shelf module or the annular flange of the male attachment structure of the second sidewall; and the female receptacle of the first sidewall includes a rear surface defining an annular recess configured for receiving the annular flange of the male attachment structure of the shelf module, for enhancing the coupling between the male attachment structure and female receptacle.

* * * * *